US005129111A

United States Patent [19]

Feinzilberg et al.

[11] Patent Number: 5,129,111

[45] Date of Patent: Jul. 14, 1992

[54] INFLATABLE CHILD'S TOILET

[76] Inventors: Jacob Feinzilberg, 17158 Palisades Cir., Pacific Palisades, Calif. 90272; Michael L. Brown, 23740 Webb Rd., Chatsworth, Calif. 91311

[21] Appl. No.: 476,590

[22] Filed: Feb. 7, 1990

[51] Int. Cl.[5] ..... A47K 11/06

[52] U.S. Cl. ..... 4/484; 4/456

[58] Field of Search ..... 4/450–457, 4/484; 5/455

[56] References Cited

U.S. PATENT DOCUMENTS

| | | | |
|---|---|---|---|
| 195,521 | 9/1877 | Merriman . | |
| 435,058 | 8/1890 | Freund | 4/456 X |
| 585,834 | 7/1897 | Ruth | 5/455 X |
| 755,747 | 3/1904 | Coile | 4/588 |
| 1,132,056 | 3/1915 | Wesley | 4/455 |
| 1,358,933 | 11/1920 | Collins . | |
| 1,362,751 | 12/1920 | Snyder . | |
| 1,981,666 | 11/1934 | Ridley . | |
| 2,503,284 | 4/1950 | Mason . | |
| 2,801,426 | 8/1954 | La Gorce et al. . | |
| 3,061,840 | 11/1962 | Presseisen . | |
| 3,464,066 | 9/1969 | Marks . | |
| 3,495,278 | 2/1970 | Peters | 4/484 |
| 3,513,488 | 5/1970 | Oring et al. | 4/451 |
| 3,579,654 | 5/1971 | Kuhn . | |
| 3,605,127 | 9/1971 | Dailey | 4/452 |
| 3,609,771 | 10/1971 | Avoy . | |
| 3,628,197 | 12/1971 | Leventhal . | |
| 4,343,053 | 8/1982 | O'Connor . | |

FOREIGN PATENT DOCUMENTS

| | | | |
|---|---|---|---|
| 1032442 | 7/1953 | France | 4/484 |
| 686682 | 1/1953 | United Kingdom | 4/484 |

*Primary Examiner*—Charles E. Phillips

[57] ABSTRACT

A differentially inflatable toilet comprising flexible plastic sheet structure forming, when inflated, a hollow body having a central well; gusset structure in the hollow inflated body for resisting lateral relative closing of the well when the body is sat upon to become deformed, and; a flexible sheet receptacle that has a first portion received in the well, and a second portion overlying and supported on the body.

6 Claims, 2 Drawing Sheets

INFLATABLE CHILD'S TOILET

BACKGROUND OF THE INVENTION

This invention relates generally to portable toilets, and more particularly to a highly advantageous, differentially inflatable toilet construction that can be rapidly set up for use, and subsequently rapidly deflated and collapsed, for example to small size kit form.

There is need for portable toilets, especially for example on family outings, traveling, etc. Prior devices of this nature were clumsy, complex, and lacked the many advantages of the present inflatable toilet, including extreme collapsibility to compact kit size, very rapid inflatability for use during emergencies, and differential inflatability to resist reduction in size of the central well wherein a soils receptacle is removably received. Without this feature, the opening, made of inflatable vinyl, has a tendency to collapse in on itself diminishing the size of the hole in the toilet seat thereby making this type of device almost unusable. This invention also has special adaptation to use by children.

SUMMARY OF THE INVENTION

It is a major object of the invention to provide an improved portable toilet meeting the above need. Basically the differentially inflatable toilet of the invention comprises, in combination:

a) flexible plastic sheet means forming, when inflated, a hollow body having a central well, b) means in the hollow inflated body for resisting lateral relative closing of the well when the body is sat upon to become deformed, and c) a flexible sheet receptacle that has a first portion received in the well, and a second portion overlying and supported on the body.

As will be seen, the hollow, inflated body typically has an outer bounding side wall that is generally upright, and an inner bounding side wall that is generally upright, the inner wall bounding the well, and the b) means comprises an auxiliary sheet that extends generally horizontally between the inner and outer side walls, and has connections thereto at locations about the well. Inflating means is normally attached to the body for rapid inflation, as will be seen, and the auxiliary sheet is constructed to pass air pressure between the body hollow interior regions, above and below auxiliary sheet level.

It is another object to provide the hollow body with a top panel and a bottom panel, each of which extends about the well, and has seam connection to the inner and outer side walls. As will be seen, the outer side wall typically bulges outwardly above and below the level of the connection of the auxiliary wall to the outer side wall; and, the inner side wall typically bulges inwardly toward the well, above and below the level of the connection of the auxiliary wall to the inner side wall. These bulges are controlled, and the side walls upright, by the auxiliary sheet.

Yet another object is the provision of an elastic band carried by the skirt portion to be stretched about the outer side wall for removably retaining the skirt portion to the body.

A further object is to provide a kit that includes a small-size container, and receiving the plastic sheet means in deflated and folded condition; and the container may also contain the unused soil receptacle, or more than one of the latter, together with a supply of toilet tissue, as will be seen.

These and other objects and advantages of the invention, as well as the details of an illustrative embodiment, will be more fully understood from the following specification and drawings, in which:

DRAWING DESCRIPTION

DRAWING DESCRIPTION

The differentially inflatable toilet 10 shown in FIGS. 1–4 includes a hollow body 110 consisting of flexible sheet means, and defining a central vertical well 13. The sheet means typically includes five multiple interconnected flexible plastic sheets, as shown.

Figure 1:
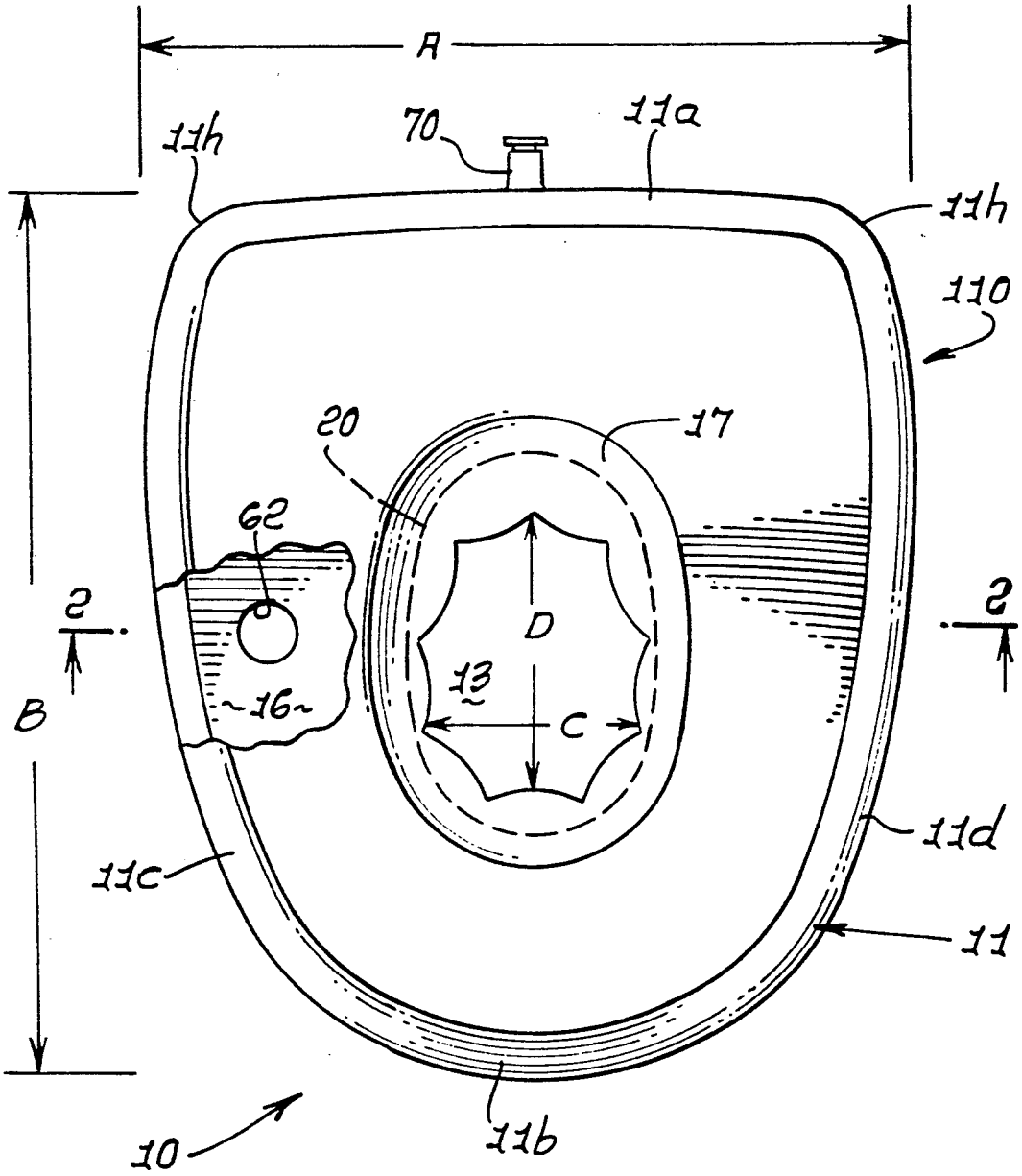
FIG. 1 is a plan view of a differentially inflatable toilet embodying the invention.

Thus, the illustrated body 11 has an outer bounding side wall 11 that is generally upright and may be toilet-shaped in plan view as seen in FIG. 1. Accordingly, wall 11 has a laterally flat rear portion 11*a*, a front portion outwardly convex at 11*b* and side sections 11*c* and 11*d* that are outwardly convex, but with lesser curvatures than is characteristic of front portion 11*b*. See also corners 11*h*.

Figure 2:
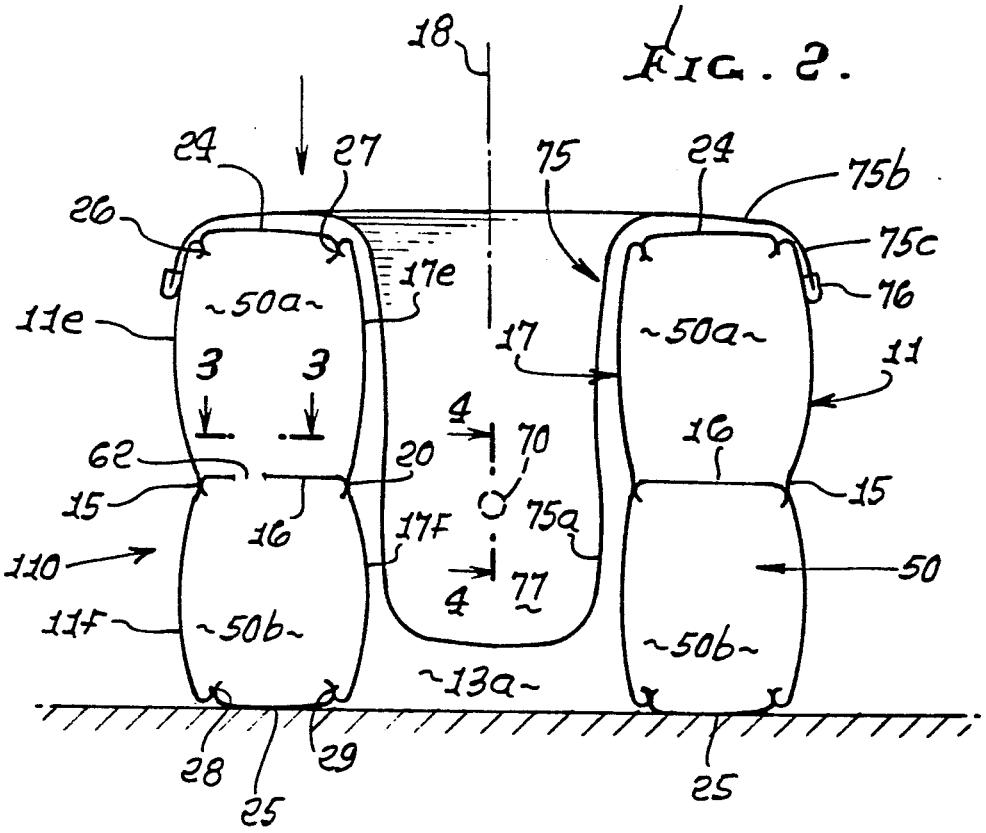
FIG. 2 is an upright section taken on lines 2—2 of FIG. 1.
Figure 3:
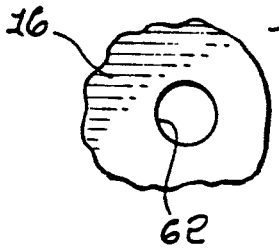
FIG. 3 is a fragmentary section taken on lines 3—3 of FIG. 2.
Figure 4:
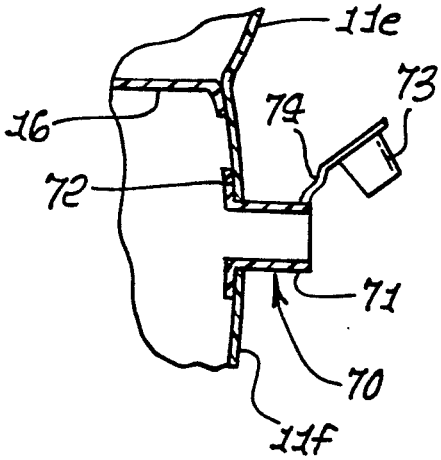
FIG. 4 is a section taken on lines 4—4 of FIG. 2.
Figure 5:
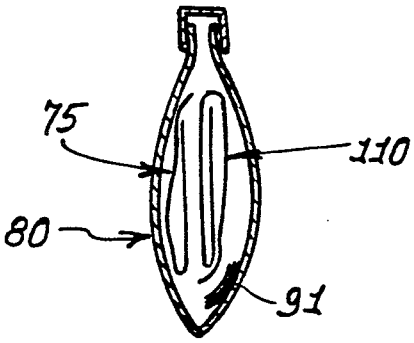
FIG. 5 shows a hand-sized kit containing the toilet in fully collapsed condition.

In FIGS. 2 and 4, it will be seen that the outer side wall 11 bulges convexly outwardly, above and below the generally horizontal level of the seam connection 15 of an auxiliary gusset or sheet 16 to the outer wall. See the upper and lower bulges indicated at 11*e* and 11*f*, these bulges both extending about the body hollow interior 50 (regions 50*a* and 50*b*); also the seam connection 15 extends about the entirety of the body hollow interior.

The body 11 also has an inner bounding side wall 17 that is generally upright and may be circular or elliptical in plan view, as seen in FIG. 1. Wall 17 bulges convexly inwardly toward upright axis 18 to define the central well 13 that extends openly upwardly from the lowermost region 13*a* (see FIG. 2). If desired, well 13 also opens downwardly, whereby the toilet is usable in FIG. 2 position, or inverted (if top or bottom is soiled, for example). Such inward bulging of wall 17 in FIG. 2 extends at two levels, i.e., above and below the level of seam connection at 20 of auxiliary wall or gusset 16 to the inner wall. See the upper and lower bulges indicated at 17*e* and 17*f*, these bulges extending about the well 13, inwardly of the hollow regions 50*a* and 50*b* referred to.

The bulges at 11*e*, 11*f*, 17*e*, and 17*f*, as referred to, extend in vertical axial planes, as per FIG. 2. It will also be indicated that these wall portions and bulges extend in horizontal planes, as is clear from wall bulging seen in FIG. 1, all such bulges occurring in inflated condition of the body, such differential inflation and bulging as described due to use of gusset 16, holding walls 11 and 17 from separating at gusset level.

The body 11 also includes a top panel 24, and a bottom panel 25. Panel 24 has seam connection to wall 11 at 26, and to wall 17 at 27; and panel 25 has seam connection to wall 11 at 28, and to wall 17 at 29. Hollow, generally annular, upper interior 50*a* communicates with hollow, generally annular, lower interior 50*b*, as via an opening or openings 62 in gusset 16. The latter serves the following purposes or functions among others:

it prevents such extreme separation of walls 11 and 17 when the toilet is sat upon, as would undesirably flatten the toilet;

it prevents such inward deflection of wall 17 as would undesirably close (at least partially and substantially) the well 13;

it strengthens (i.e., rigidizes) the toilet structure;

it enables provision (without undue collapse under weight) of an upstanding inflatable toilet of at least about ten inches height.

Body inflator means indicated at 70 allows very rapid (about 10–15 seconds) breath inflation of the hollow body. It includes a tube 71 attached as by seaming at 72 to the wall 11 at the rear side of the toilet. A cap or plug 73 frictionally fits in the tube to close the body when filled with air, i.e., inflated. Plastic hinge 74 connects the cap to the side of the tube. No interior check valve is required Air pressure communicates via opening 62 between the differentially inflated upper and lower body hollows 50*a* and 50*b*.

Also provided is a flexible sheet receptacle 75 that has a first, i.e., lower, portion 75*a* that is loosely received in the well 19; and a second, i.e., upper, portion 75*b* extendible over the body to overlie top panel 24 for support thereon The plastic sheet receptacle may be fitted about the upper extent of outer wall, as seen at 75*c* in FIG. 2; and an elastic band 76 may be integrated with the upper edge of the receptacle to grip the outer wall 11, and hold the receptacle in centered position, as shown, during toilet use. After such use, the receptacle may be quickly and easily closed and removed from the toilet well 13 for removal and disposal of the contents See pocket 77 formed by 75*a*.

The body 11 has overall cross dimensions (as in FIGS. 1 and 2) A and B within the range of about 10½ to about 13½ inches; and the well 13 has overall cross dimensions C and D within the range of about 5 to 7 inches.

The body 110, as described, as well as the receptacle 75, are sized to be fold-collapsed and to fit within a holder or container 80 which is hand-sized and thereby form a kit or package that may be carried within a woman's handbag or purse. Thus, the kit is particularly adapted to emergency use by children after rapid inflation by the child's mother, for example. Toilet tissue 91 is also contained in the kit.

As clearly shown in FIG. 2, the inner and outer side walls 11 and 17, top panel 24, bottom panel 25 and auxiliary sheet 16 define in vertical cross section, upper and lower substantially rectangular sections. For example the walls at 11*e* and 17*e*, and the panels 16 and 24 define a substantially rectangular upper section to the left of axis 18; and the walls at 11*f* and 17*f*, and panels 16 and 25 define a substantially rectangular lower section.

We claim:

1. A differentially inflatable toilet combination comprising:

five flexible plastic sheets forming, when assembled and inflated, a generally toroidal hollow body having a central well open at both ends, said body having a first sheet in the form of an outer bounding side wall that is generally upright, a second sheet in the form of an inner bounding side wall that is generally upright, the inner wall bounding the well, said outer bounding side wall having a rear portion that is substantially flat and a front portion that is outwardly convex, joined by two side portions that are outwardly convex with lesser curvatures than said front portion, a third sheet comprising a generally annular auxiliary sheet that extends generally horizontally between said inner and outer side walls, and has seam connections thereto at locations about the well, the body including fourth sheet in the form of a top panel and a fifth sheet in the form of a bottom panel, each of which extends generally annularly about said well, and has seam connections to said inner and outer side walls at their top and bottom respectively, said top and bottom panels extending substantially horizontally, the inner and outer side walls, top panel, bottom panel and auxiliary sheet defining in vertical cross section, upper and lower substantially rectangular sections, the well having a diameter or width in a plane near said top panel that is substantially less than the well overall height, and including an inflator means attached to the boy, said auxiliary sheet forming an opening between said inner and outer walls to pass air between portions of the hollow body above and below the auxiliary sheet, said outer upright side wall bulging outwardly above and below the level of the connection of the auxiliary sheet to the outer side wall, the auxiliary sheet located about half way between the top and bottom panels, so as to resist lateral relative closing of the well when the body is sat upon to become deformed, and the inner side wall bulging inwardly toward the well, above and below the level of the connection of the auxiliary sheet to the inner side wall, the vertical spacing between said top panel and auxiliary sheet substantially exceeding the horizontal dimensions of said auxiliary sheet and top panel, between the inner and outer walls at one side of the well, said well having cross dimensions within the range of about five inches to about seven inches, the body having cross dimensions within the range of about 10½ inches to about 13½ inches, a flexible sheet receptacle that has a first portion receive din the well, and a second portion overlying and directly supported on said body.

2. The combination of claim 1 wherein the sheet receptacle has a skirt portion closely enveloping the body outwardly of said outer side wall, and above the level of said auxiliary sheet.

3. The combination of claim 2 including an elastic band carried by said skirt portion to be stretched about said outer side wall for removably retaining the skirt portion to the body.

4. The combination of claim 1 wherein the plastic sheet means, when deflated, is folded into compact form, and including a relatively small size container receiving said folded plastic sheet means to form a kit.

5. The combination of claim 4 wherein said receptacle is also folded into compact form and received into said container.

6. The combination of claim 5 including toilet tissue also carried by said container.

* * * * *